US005345149A

United States Patent [19]

Ham

[11] Patent Number: 5,345,149

[45] Date of Patent: Sep. 6, 1994

[54] LIGHTING SYSTEM WITH FLUORESCENT AND INCANDESCENT LAMPS

[76] Inventor: Byung I. Ham, 2672 Monterey Pl., Fullerton, Calif. 92633

[21] Appl. No.: 904,708

[22] Filed: Jun. 26, 1992

Related U.S. Application Data

[63] Continuation-in-part of Ser. No. 661,862, Feb. 27, 1991, Pat. No. 5,179,323.

[51] Int. Cl.[5] ..... H05B 37/00

[52] U.S. Cl. ..... 315/244; 315/246; 315/179; 315/254

[58] Field of Search ..... 315/313, 162, 244, 254, 315/246, 178, 179; 362/228, 229, 225, 231

[56] References Cited

U.S. PATENT DOCUMENTS 4,350,929 9/1982 Katoogi ..... 315/179
4,399,492 8/1983 Kolesar ..... 362/231

*Primary Examiner*—Paul Gensler
*Assistant Examiner*—Haissa Philogene
*Attorney, Agent, or Firm*—Blakely, Sokoloff, Taylor & Zafman

[57] ABSTRACT

A lighting system using a 120 volt AC power source and including within a single enclosure a low wattage fluorescent lamp and a low wattage incandescent lamp. The fluorescent lamp provides an efficient light source operating at a low voltage and low wattage, but providing a relatively bright light. The incandescent lamp may be used to provide a more traditional night light having a lower light output than that which is produced by the flourescent lamp. Either the fluorescent lamp or the incandescent lamp is selected by a switch. To obtain the low voltage required by the incandescent lamp, a resistor is placed in parallel with a capacitor to provide a small voltage drop, e.g., from 120 volts to 115 volts. In this configuration, due to the charging and discharging of the capacitor as the current alternates and discharges through the resistance of the incandescent lamp, a relatively low voltage and current pass through the incandescent lamp.

4 Claims, 4 Drawing Sheets

LIGHTING SYSTEM WITH FLUORESCENT AND INCANDESCENT LAMPS

This is a continuation-in-part of application Ser. No. 07/661,862 filed Feb. 27, 1991 now U.S. Pat. No. 5,179,323 which issued Jan. 12, 1993.

BACKGROUND OF THE INVENTION

1. Field of the Invention

The present invention relates to a mini-lamp or nightlight which utilizes two light sources, one using a compact L-C ballast having a capacitor in series with a transformer that uses a primary coil and a shorted secondary coil, adapted for use in a low wattage fluorescent lamp, and the second using a capacitor in series with an incandescent lamp to provide a lower level of light output than the flourescent lamp.

2. Description of the Prior Art and Related Information

Fluorescent lamps of all types are very popular for use in the home or office because of their high operating efficiency as compared to incandescent lamps. Indeed, fluorescent lamps emit light at several times the efficiency of a typical incandescent lamp. Furthermore, fluorescent lamps do not generate as much heat as a typical incandescent bulb, thereby conserving radiant energy in that respect.

A typical fluorescent lamp is constructed from a glass tube that contains two electrodes at opposite ends, a coating of powdered phosphor covering the interior of the tube, and small amounts of mercury. The electrodes when energized provide a large potential across which free electrons initiate an arc. The radiant energy from the arc contains shortwave ultraviolet energy that is converted into light by the phosphor coating. In this process, the fluorescent effect is caused by the mercury when it is vaporized in the arc.

Furthermore, most fluorescent lamps require a ballast. A ballast is necessary to maintain constant current flow into the lamp. In a ballast resistor, for example, the resistance increases as temperature increases. As resistance increases, less current is allowed through, thus lowering the temperature and consequently lowering the resistance. Current flow is thus maintained at a constant level.

Ballast action for a fluorescent lamp can also be obtained through use of an inductor/capacitor ballast (i.e., L-C ballast). In such a ballast, the capacitor continually charges and discharges while the inductor loads and unloads the circuit, thereby continually regulating current flow to the fluorescent lamp.

In a conventional L-C ballast for a low wattage (e.g., 4 to 8 watt) fluorescent lamp, the inductor typically requires 1200 turns in its coil. Because of the number of turns, power consumption is great and energy is wasted in the inductor when converted to heat. Not only is energy wasted in the conventional ballast, the labor and material required to build an inductor with 1200 turns is accordingly high. Finally, the durability and life expectancy of a lamp running that hot is questionable. Accordingly, there is a need for an efficient operating ballast for a low wattage fluorescent lamp.

SUMMARY OF THE INVENTION

In order to overcome the obstacles and drawbacks of the prior art, the present invention provides an L-C ballast for a low wattage fluorescent lamp that features a transformer with a primary coil and a secondary coil. By having a secondary coil, the present invention requires fewer coil turns than the single coil inductor in a prior art L-C ballast.

In a preferred embodiment, the present invention provides an L-C ballast for a low wattage, mini fluorescent lamp operating at 4 watts or less. In this preferred embodiment L-C ballast, a capacitor is placed in series with a transformer. The transformer has a primary coil, a core, and a shorted secondary coil. Preferably, the primary coil should have 380 to 550 turns while the secondary should have 15 to 30 turns. It is also suggested that the coils use wiring having a size ranging from number 31 to 34 gage AWG (American Wire Gage).

An optional resistor may be connected in parallel across the transformer. In some applications, the fluorescent lamp requires the resistor to dampen current surges that may cause the lamp to flicker. It is suggested that the resistor have a resistance ranging from 100 ohms to 300 ohms.

The ballast is connected in series to a fluorescent tube and a starter. Naturally, a power input is required to supply the necessary voltage to drive the entire circuit.

Because the transformer uses two coils, there are fewer turns per coil. As a result, construction of the ballast is simplified and its physical dimensions may be reduced significantly. Unlike prior art lamps, the present invention does not require a bulky ballast that is often difficult to integrate with many modern lamp designs. To be sure, the smaller size of the ballast allows incorporation into a miniature fluorescent lamp or other miniature lamp configurations. In addition, material cost for the smaller ballast decreases while its simplicity improves durability.

Another unique feature of the transformer is its shorted secondary coil. As already mentioned above, the shorted secondary coil reduces the number of turns required in the transformer. There are many inherent benefits stemming from fewer turns. For instance, because of fewer turns, the transformer can utilize a smaller core, again reducing cost, bulk and complexity of the mechanism. Fewer turns mean reduced noise emitted by the transformer. Lamp efficiency increases. Even tube life is increased up to three times the tube life in conventional fluorescent lamps.

The ballast provided by the present invention also does not run as hot as prior art ballasts. For comparison, prior art ballasts operate at temperatures ranging from 90 to 100 degrees Celsius, while the present invention operates at 50 to 60 degrees Celsius. Associated benefits from lower operating temperatures include a smaller chance for accidental overheating and fires, a smaller possibility of a consumer getting burned on a hot ballast, lower cost of materials that need not endure high temperatures, etc.

Therefore, it is an object of the present invention to provide a L-C ballast for a low wattage fluorescent lamp that uses 380 to 550 turns in its primary coil, and 15 to 30 turns in its secondary. It is another object of the present invention to provide a L-C ballast that is physical smaller and operates at lower temperatures than prior art ballasts. It is yet another object of the present invention to provide a L-C ballast that has a simpler construction than prior art devices.

Additionally, the lighting system which uses a 120 volt AC power source, includes within a single enclosure the low wattage fluorescent lamp and L-C ballast described above and a low wattage incandescent lamp. The fluorescent lamp provides an efficient light source operating at a low voltage and low wattage, but produces a relatively bright light. The incandescent lamp may be used to provide a more traditional night light having a lower light output than that which is produced by the flourescent lamp. Either the fluorescent lamp or the incandescent lamp is selected by a switch. To obtain the low voltage required by the incandescent lamp, a resistor is placed in parallel with a capacitor to provide a small voltage drop, e.g., from 120 volts to 115 volts. In this configuration, due to the charging and discharging of the capacitor as the current alternates and discharges through the resistance of the incandescent lamp, a relatively low voltage and current pass through the incandescent lamp.

DETAILED DESCRIPTION OF THE INVENTION

The following detailed description outlines a L-C ballast for a low wattage mini fluorescent lamp. In the following description, numerous details such as specific materials and configurations are set forth in order to provide a more complete understanding of the present invention. But it is understood by those skilled in the art that the present invention can be practiced without these specific details. In other instances, well-known elements are not described in detail so as not to obscure the present invention. In any event, the scope of the invention is best determined by reference to the appended claims.

Figure 1:
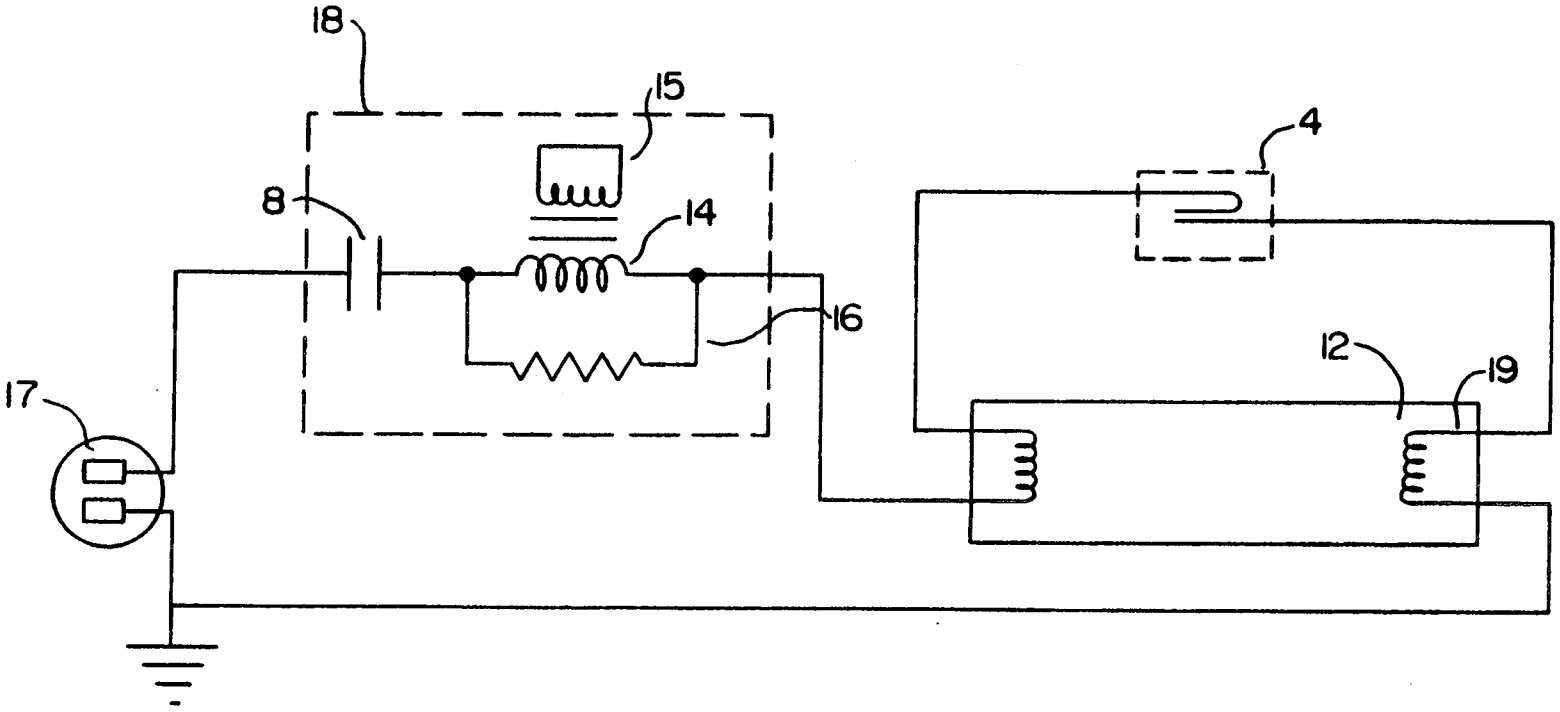
FIG. 1 is a schematic diagram of an embodiment of the present invention using just a low wattage mini flourescent lamp.

FIG. 1 illustrates a preferred embodiment of the present invention L-C ballast. As shown, an L-C ballast 18 is connected in series with a fluorescent tube 12 and a starter 4, with 60 cycle AC voltage supplied from a power source 17. The ballast 18 is comprised of a capacitor 8 connected in series with a transformer 9 having a primary coil 14 and a secondary coil 15. In the preferred embodiment, the capacitor 8 should preferably be rated at 220 volts AC, with a capacitance of 3.0 to 3.5 microfarads. Down the line is the choke coil or transformer 9. In the transformer 9, the primary coil 14 should have approximately 380 to 550 turns; and the secondary coil 15 should have 15 to 30 turns. It is suggested that wiring for the coils range in size from number 31 to 34 AWG.

In the present invention, the preferred embodiment is used to drive a 4 watt mini fluorescent lamp. For this specific 4 watt lamp application, the transformer 9 should have 500 turns in the primary coil 14 and 28 turns in the secondary coil 15, with both coils made from number 33 AWG wire. Also, the transformer 9 should have a core made from laminated steel.

As illustrated in FIG. 1, the transformer 9 provided by the present invention uses a primary coil 14 and a secondary coil 15. The secondary 15 has no electrical load and is shorted together. The presence of the secondary coil 15, however, is a departure from prior art technology. That is, conventional inductors in L-C ballasts have only a single coil wrapped around a core and do not contain a secondary coil. For lack of a secondary coil, the primary coil in conventional ballasts requires up to 1200 turns for a low wattage lamp. Associated inefficiency and heat build-up consequently appear.

On the other hand, the present invention utilizes a secondary coil 15 to distribute the inductor load between two coils. Fewer turns per coil are necessary resulting in lower heat build-up and greater operating efficiencies.

In certain lamp applications, a resistor 16 is necessary to be added in parallel with the transformer 9. It is suggested that the resistor 16 have a resistance ranging from 100 to 300 ohms. Without this resistor 16, certain lamps are prone to flickering. Therefore, the resistor 16 dampens current surges and ensures that the arc flowing between electrodes 19 of the fluorescent tube 12 remains continuous. In sum, the charging and discharging of the capacitor 8 and loading and unloading of the magnetic field in the transformer coils 14 and 15 collectively ensure that current flowing therethrough to the fluorescent tube 12 is regulated as is the function of a ballast.

Connected in parallel to the fluorescent tube 12 is a starter lamp 4. In a preferred embodiment, the starter lamp 4 should be a Sylvania Electronics Company starter lamp, part no. GB-22-48222-0, or its equivalent. Alternatively, a glow bottle starter, a sidac system starter, or a triac system starter may be used. The starter lamp 4 is necessary to charge up sufficient potential so that an arc can initiate between electrodes 19 inside the fluorescent tube 12. Once the arc is initiated, visible light is produced from the fluorescent tube 12 in a process known in the art.

Figure 2A:
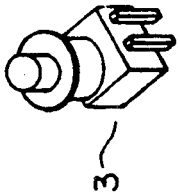
FIG. 2*a* is an alternate embodiment of switch 3 shown in FIG. 2.
Figure 2:
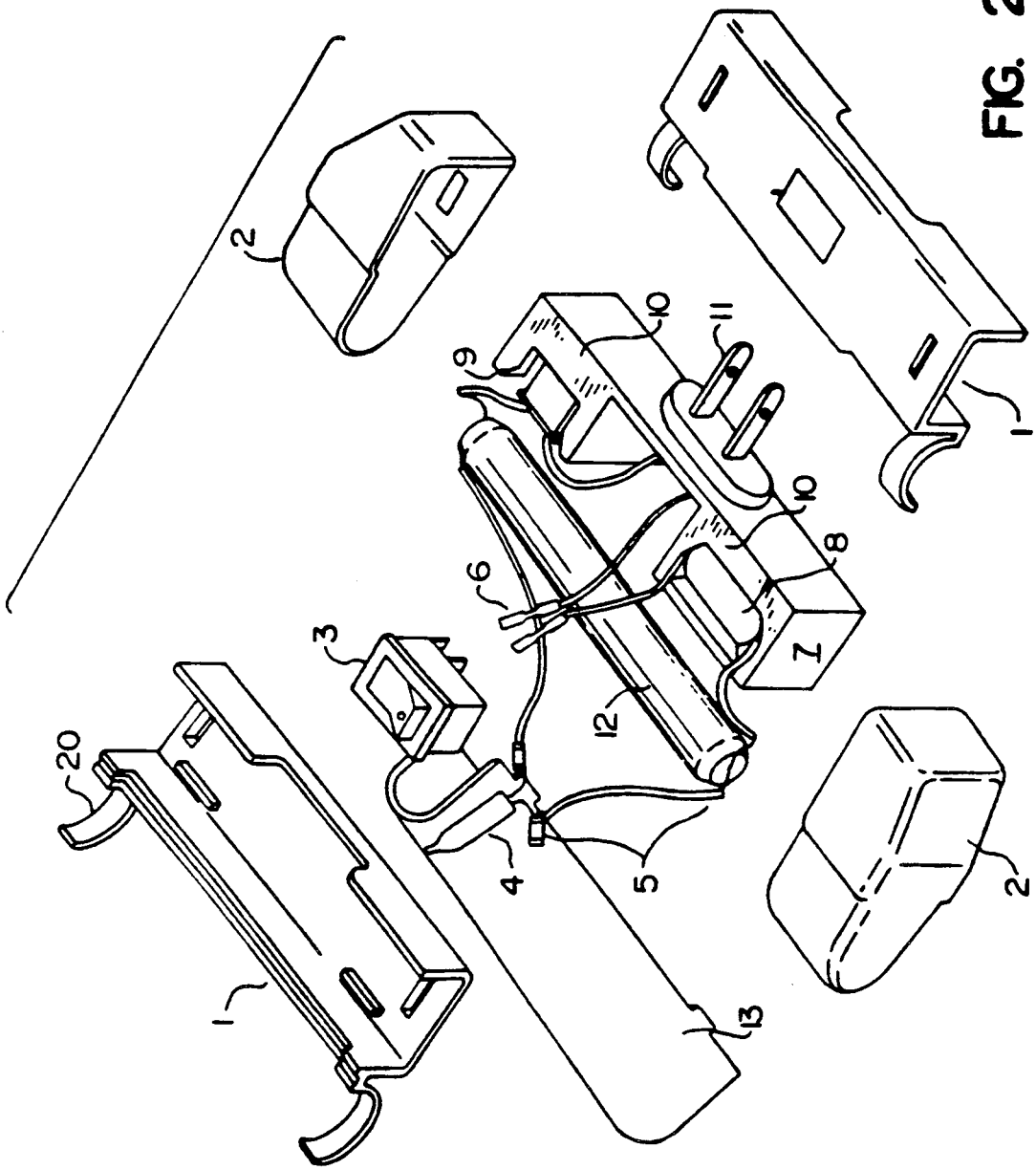
FIG. 2 is an exploded view of a mini fluorescent lamp having the present invention incorporated therein.

FIG. 2 is an exploded perspective view of the present invention as incorporated into a low wattage, miniature fluorescent lamp. As can be seen in this view, power is supplied from a wall socket through plug 11. Current then travels through power source lead 6 and into the ballast, made up of capacitor 8 and transformer 9, both of which are encased in body 10 having squared off ends 7. Output from the transformer 9 is connected to fluorescent tube 12 which has a starter lamp 4 connected in parallel thereto. A rocker switch 3 connected to power source lead 6 enables the circuit to be opened or closed. It is suggested that the switch 3 be rated for 125 VAC at 3 amps. Alternatively, a pushbutton switch may be used in place of the rocker switch 3, as is shown in the inset view of FIG. 2. Obviously, other switches known in the art are possible. Electrical conductor 5 in this preferred embodiment is made from number 18 AWG electrical wire. End caps 2 slide over the ends 7 of the body 10 while base halves 1 cover the rest of the wiring and electrical components. Curved supports 20 extending from the base halves 1 clamp the fluorescent tube 12 in position. Lastly, a translucent lens cover 13 snaps over the fluorescent tube 12 to obtain proper light dispersion.

In the preferred embodiment, the lens cover 13, base halves 1, and end caps 2 should be made from a plastic polycarbonate or ABS (flame retardant type). The body 10 may be molded from a heat resistant epoxy.

In sum, the present invention provides a L-C ballast for a low wattage, miniature fluorescent lamp that includes an efficient transformer which operates at cooler temperatures and occupies a smaller space than prior art ballasts. The present invention ballast also is easier and less expensive to manufacture.

Figure 10:
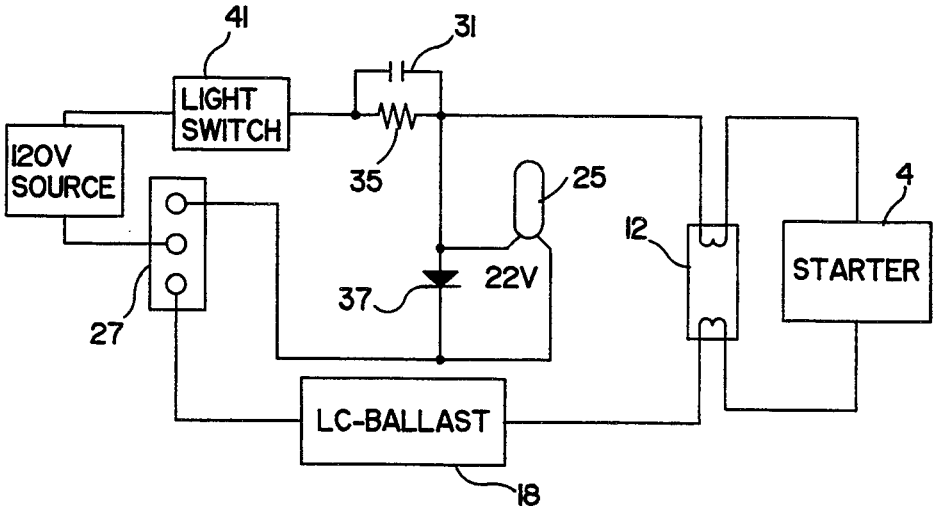
FIG. 10 is a schematic diagram of a lighting system including a low wattage mini flourescent lamp and a low wattage incandescent lamp.

In an alternate embodiment of the invention, as shown in FIG. 10, an incandescent lamp 25 and two position switch 27 may be used to provide a more traditional night light having a lower light output than that which is produced by fluorescent lamp 12. Elements in FIG. 10 having the same reference numbers as elements in FIG. 1 provide the same function as the corresponding elements in FIG. 1.

Since it is desired that incandescent lamp 5 produce a low level of light, lamp 25 is a low voltage, low wattage lamp. Typical values for such a lamp are 24 volts and 2.5 watts. Normally, when the voltage source is 120 volts AC, a step down transformer is used to reduce the voltage from 120 volts to the 24 volts required by the lamp. However, a transformer is bulky and would increase the overall dimensions of the night light. In this connection, it has been determined that satisfactory results can be obtained by placing a capacitor 31 in series with lamp 25. A resistor 35 is placed in parallel with the capacitor 31 to provide a small voltage drop, e.g., from 120 volts to 115 volts. In this configuration, due to the charging and discharging of capacitor 31 as the current alternates and discharges through the resistance of lamp 25, a relatively low voltage and current pass through lamp 25. For example, with a one megaohm resistor 35 and a one microfarad capacitor 31, the voltage drop across lamp 25 is about 22 volts.

A selector switch 27 coupled to L-C ballast 18 at one pole and to incandescent lamp 25 at the other provides power to either the fluorescent lamp 12 or to the incandescent lamp 25 depending on the position of switch 27.

Diode 37, while not necessary, operates to rectify the alternating current and may provide a more even light output from lamp 25. Switch 41 is an on-off switch to the entire lighting system.

Figure 3:
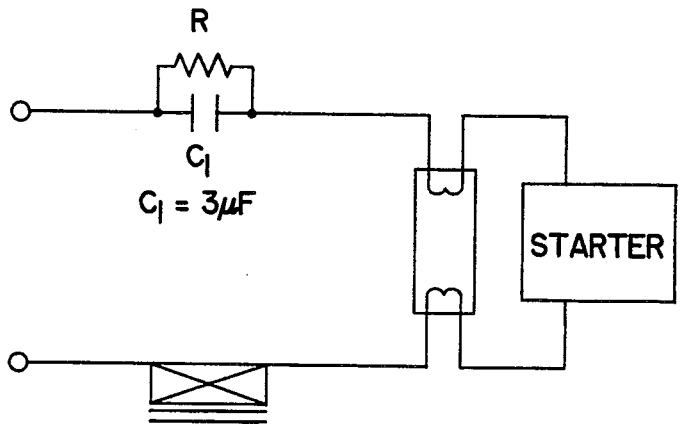
FIG. 3 shows the basic ballast circuit for 4 W fluorescent lamp.

FIG. 3 shows the basic ballast circuit for 4 W fluorescent lamp, and FIG. 4–FIG. 7 show the circuits for a miniature lamp which can be integrated with the basic circuit in FIG. 3.

For the rated voltage and current, capacitors ($C_1$, $C_2$) are used to drop the voltage by using the phase difference between the voltage and current of the AC source. Resister (R) is used for discharge of the capacitor.

Figure 4:
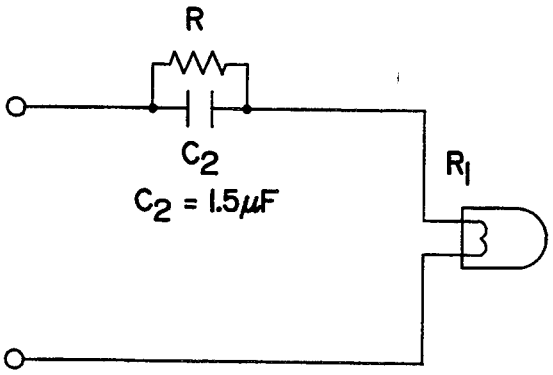
FIG. 4–FIG. 8 show the circuits for a miniature lamp which can be integrated with the basic circuit in FIG. 3.

The circuit in FIG. 4 can be used with 1.5 $\mu$F capacitor ($C_2$), but it has a disadvantage of high cost because an additional capacitor is needed.

Figure 5:
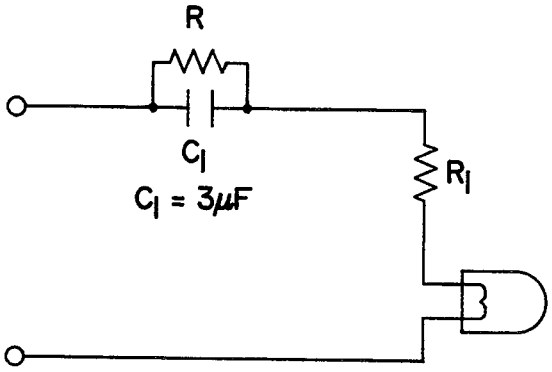

In the circuit in FIG. 5, a resister ($R_1$) can be used with the capacitor ($C_1$) to adjust the lamp voltage, but it consumes more power and also has a heat problem.

Figure 6:
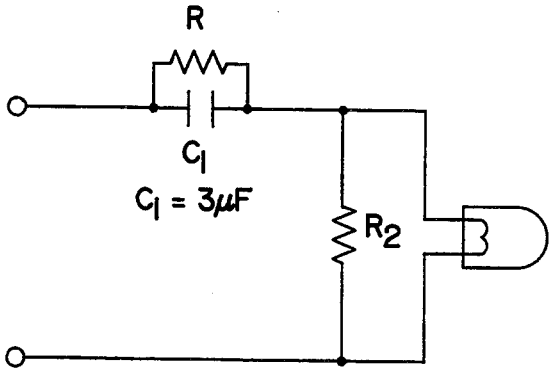

If a resister ($R_2$) is attached in parallel with the lamp as in FIG. 6, the current through the lamp can be reduced. For example, if the resistance of the lamp and $R_2$ are the same, the equivalent resistance decreases to $\frac{1}{2}$.

Since $E=I * R$ and I is fixed, E (the lamp voltage) will decrease as $R_2$ decreases.

In FIG. 6, the current I through the circuit is divided into $I_1$ and $I_2$. For example, when $I=100$ mA, if the resistance of $R_2$ and the resistance of the lamp are the same, $I_1$ and $I_2$ would be both 50 mA.

But the circuit in FIG. 6 also has a heat problem when the lamp filament is gone, since 100 mA current will flow through $R_2$ in that case.

Figure 8:
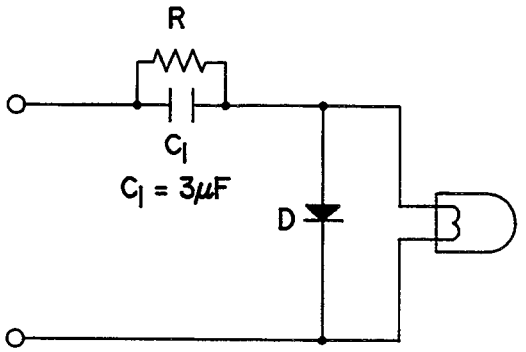

In the circuit in FIG. 8, a diode (D) is attached in parallel with the lamp, and the current flows through the diode in the first half-period and flows through the lamp in the second half-period. Therefore, the lamp current is reduced to $\frac{1}{2}$ as in FIG. 6 with a resistor ($R_2$).

Figure 7:
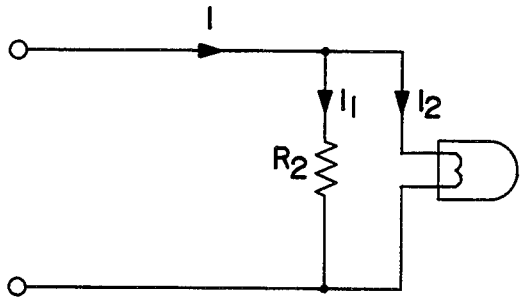

The advantage of this scheme is that the power loss ($P=I^2R$) is negligible, and there is no heat problem. FIG. 7 shows the current flow through the circuit in FIG. 6.

Figure 9:
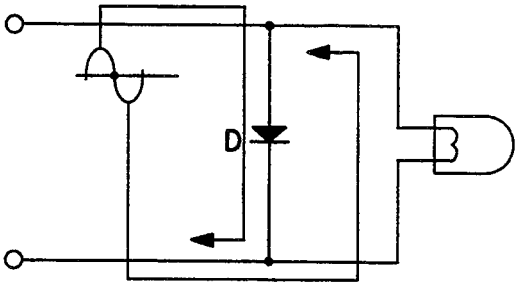
FIG. 9 show the current flows through the lamp during only half of the whole period.

As shown in FIG. 9, the current flows through the lamp during only half of the whole period. Precisely, a little current flows through the lamp when the current flows through the 5 diode (D), because of $V_F$ (forward voltage) of D.

As a conclusion, by combining the circuit using a diode (FIG. 8) with the basic circuit for the 4 W fluorescent lamp (FIG. 3), a simple circuit to use both lamps together can be constructed as shown in FIG. 10.

I claim:

1. A lighting system using a 120 volt AC power source and including within a single enclosure a low wattage fluorescent lamp and a low wattage incandescent lamp, said lighting system comprising:

a) ballast means coupled between said fluorescent lamp and said AC power source;

b) a resistor and capacitor pair directly connected in parallel and between said AC power source and one contact of said incandescent lamp, said resistor and capacitor pair adapted to reduce the voltage of said AC power source by approximately 20%, a second contact of said incandescent lamp being coupled to said AC power source, wherein one contact of said flourescent lamp is coupled to said one contact of said incandescent lamp.

2. The lighting system defined by claim 1 further comprising switch means coupled between said AC power source, said ballast means and said second contact of said incandescent lamp for selecting one of said fluorescent lamp and said incandescent lamp to couple to said AC power source.

3. The lighting system defined by claim 1 further comprising a diode coupled in parallel with said incandescent lamp.

4. The lighting system defined by claim 1 wherein said resistor is a one megaohm resistor and said capacitor is a one microfarad capacitor.

* * * * *

UNITED STATES PATENT AND TRADEMARK OFFICE

CERTIFICATE OF CORRECTION

PATENT NO. : 5,345,149

DATED : September 6, 1994

INVENTOR(S) : Byung I. Ham

It is certified that error appears in the above-identified patent and that said Letters Patent is hereby corrected as shown below:

In column 5 at line 19 change "lamp 5" to -- lamp 25 --

In column 6 at line 26 change "through the 5 diode" to -- through the diode --

Signed and Sealed this

Eighteenth Day of April, 1995

Bruce Lehman

BRUCE LEHMAN

*Commissioner of Patents and Trademarks*

*Attest:*

*Attesting Officer*